US005806632A

United States Patent [19]

Budd et al.

[11] Patent Number: 5,806,632

[45] Date of Patent: Sep. 15, 1998

[54] SPRING ASSIST SYSTEM FOR GRAVITY DEPLOYMENT OF STOWED PLATFORM WHEELCHAIR LIFTER

[75] Inventors: Alfred L. Budd; James R. Pierrou; Barry E. Wolff, all of Winamac, Ind.

[73] Assignee: The Braun Corporation, Winamac, Ind.

[21] Appl. No.: 843,497

[22] Filed: Apr. 16, 1997

Related U.S. Application Data

[60] Provisional application No. 60/041,709 Mar. 26, 1997.

[51] Int. Cl.[6] ..... B66B 9/08

[52] U.S. Cl. ..... 187/200; 414/921

[58] Field of Search ..... 187/200, 211, 187/269; 414/921, 545, 546, 917; 180/268, 270

[56] References Cited

U.S. PATENT DOCUMENTS 5,261,779 11/1993 Goodrich ..... 414/921

*Primary Examiner*—Kenneth Noland

*Attorney, Agent, or Firm*—Jacques M. Dulin, Esq.; Heller, Ehrman, White & McAuliffe

[57] ABSTRACT

A wheelchair platform free fall control system comprising use of a tension means, such as at least one spring, biasing together the long and short arms of a lever arm assembly that keeps the lever arm slide block in contact with a lifting arm during gravity-down deployment of said platform from an over-vertical stowed position to a horizontal transfer position. A compression means may be used in conjunction with the lifting arm assembly to assist in overcoming the resting momentum of the lift platform mass from over-vertical outwardly until gravity takes over. The tension means may be one or more springs and the compression means may be a gas spring. The forces are preselected to provide lifting assembly over-vertical assist while keeping the sliding block in substantial contact with an arm of the lifting assembly. The springs can be used with a stud/slot interlock. Torsion springs are preferably eliminated.

17 Claims, 3 Drawing Sheets

SPRING ASSIST SYSTEM FOR GRAVITY DEPLOYMENT OF STOWED PLATFORM WHEELCHAIR LIFTER

CROSS-REFERENCE TO RELATED APPLICATION

This application is a regular utility application claiming priority under 35 U.S.C. §119(e) of Provisional Application Ser. No. 60/041,709 filed Mar. 26, 1997, the disclosure of which is hereby incorporated by reference.

1. Technical Field

This application relates to wheelchair lifts having stowable platforms, and more particularly to dual parallelogram type lifts employing an articulated lever assembly having a sliding block for leveraging the platform from a horizontal transfer orientation to a vertical, or over-vertical stowage position. A spring assist system comprising a gas spring and at least one articulated lever assembly closure spring is provided to assist the unfolding (deployment) of the platform in a gravity-down mode from an over-vertical stowed position without uncontrolled parallel motion of the platform and sudden free fall into a more nearly horizontal orientation.

2. Background Art

Parallelogram type wheelchair lifts are offered by a number of manufacturers, including The Braun Corporation of Winamac, Ind. in its L900 series of lifts, as shown in its U.S. Pat. No. 5,261,779, and by Ricon Corporation of Pacoima, Calif. in its S-series of lifts, as shown in U.S. Pat. No. 4,534,450 and expired Re 31,178. These lifts employ various mechanisms to cause the platform to move arcuately upward from the horizontal transfer level to a vertical or over-vertical stowage position. One system involves the use of an articulated lever assembly comprising a pair of arms of unequal length pivotably connected to each other at one end, and pivotably connected at their other ends respectively to: a) the vertical lift arm end link, at the bottom end of which is pivotally secured the platform, and b) the inboard end of the platform. As the hydraulic ram in the lifting assembly is actuated, lifting the platform from the ground level toward the transfer level, a sliding block, pivotally secured at the common center of the two arms, comes into contact with the lower arm of the parallelogram. As the lifting continues and the end link approaches the lower arm, the lower longer arm of the lever assembly is pushed downwardly. In turn this causes the outboard end of platform to rotate upwardly to the stowed position.

Occasionally there is loss of hydraulic fluid pressure and the platform can drift outwardly, generally parallel to the stowed position. When mounted inboard of a vehicle, e.g. the side or rear door of a van or bus, the platform bottom (inboard end) can drift away from the stanchions on which the parallelogram arms are mounted and interfere with the opening of the vehicle door.

These types of lifts also involve the use of single acting hydraulic cylinders which either pull (Braun U.S. Pat. No. 5,261,779) or push (Ricon Re 31,178) to both lift and stow the platform, while allowing gravity to bring the platform down from the upright stowed position by release of hydraulic pressure in the active side of the hydraulic cylinder that actuates the parallelogram arms: However, the preferred position of the platform is over-vertical to secure it during vehicle motion. Accordingly, the Braun L900 series employs a gas spring mounted in the lower channel arm of each of the parallelograms to push the parallelograms outwardly, causing the platform to move outwardly over the vertical position to a point where gravity can take over for the further deployment of the platform.

In some instances, for example, where the vehicle may not be level, where frictional forces may build up in the outboard link (lifting arm) platform pivot, or where the two parallelogram arms bind or are not synchronized, etc., the platform may move outwardly from the stowed position, but parallel thereto, rather than rotating from its lower end smoothly down to the deployed horizontal transfer level. The platform can then rotate down in a sudden arcuate movement (free fall) when the parallelogram moves far enough out and down that gravity pulls the platform down as well. This motion can be sudden and disconcerting to observers, particularly those outside the vehicle, albeit not ordinarily dangerous as there is no one on the platform, unless a person outside the vehicle is standing where he or she should not be, that is, in the intended and usual path of the descending lift.

One proposed solution is the use of a common stud and slot assembly, such as used in the Braun L200 series telescoping arm-type lift since circa 1978 (e.g., the whale and bearing assembly in Braun Model L211U), or the stud and slot assembly in the sliding saddle block of Saucier U.S. Pat. No. 5,605,431 of Ricon (as shown in FIGS. 13–15 thereof). Both of these releasably interlock the platform to the lifting assembly during the gravity down phase of the platform deployment from vertical to horizontal transfer level, thus preventing platform movement in a sudden pivotal free fall. However, the Braun whale/bearing system, while mechanically outstanding, is relatively expensive. The saddle block stud/parallelogram slot assembly of Ricon, while cheap, is prone to wear and binding. The underarm stud/slot assembly of Ricon introduces another pair of binding points in the spaced parallelogram arms that must be kept in synchrony. This becomes increasingly difficult as the two spaced lifting parallelograms may not move equally during long term use cycles due to wear on hydraulic pistons or rods, or the build up of friction in pivots, or sediment or gum development in hydraulic lines, or torsional twisting when the vehicle is not level, or the like. Accordingly, underarm stud/slot interlocks on the bottom surface of the lower parallelogram arms are not necessarily the best or only solution to preventing occasional platform free fall.

Still another solution has been to provide torsion springs at two or more diagonally opposed pivots of the parallelogram to assist in moving the parallelogram and platform out from the over-vertical stowed position, or a torsion spring at the saddle (sliding) block pivot pin. However, such springs can weaken or break over time as they are over stressed, and are relatively difficult to replace.

SUMMARY, OBJECTS AND ADVANTAGES OF THE INVENTION

It is among the objects and advantages of the invention to provide an inexpensive system to promote movement of the articulated lever with the parallelogram during deployment in the gravity down mode from the vertical stowed position to the horizontal transfer position to prevent platform free fall. Other objects advantages will be evident from the descriptions, drawings and claims of this invention.

The invention comprises providing at least one tension-type spring bridging diagonally between the two arms of the articulated lever adjacent the sliding block, or between one arm and the lift arm. This brings or keeps the two arms together, forcing the sliding block upwardly against the lower arm of the parallelogram. In addition, the parallelogram arm is assisted during deployment by the use of a gas spring to bring the platform back outward (toward the outboard position) from the over-vertical position. Since this gas spring is under compression, if the hydraulics loose pressure, the gas spring will tend to cause the platform to drift out from the over-vertical position. In the case of the stud/slot type assembly such drift will also cause the platform to rotate, and the top (outboard end) of the platform can interfere and/or significantly mar the van door. In contrast, with the articulated arm spring system of this invention, those springs counteract platform drift from hydraulic pressure loss or drift induced when the vehicle turns left or tilts down to the right. Accordingly, it is an important aspect of the invention to balance the two spring forces, the inward net tension force of the diagonal articulated arm spring(s) against the outward compression force of the parallelogram arm assist gas spring.

BRIEF DESCRIPTION OF DRAWINGS

The invention is illustrated by reference to the drawings in which.

DETAILED DESCRIPTION OF THE BEST MODE OF CARRYING OUT THE INVENTION

The following detailed description illustrates the invention by way of example, not by way of limitation of the principles of the invention. This description will clearly enable one of ordinary skill in the art to make and use the invention, and describes several embodiments, adaptations, variations, alternatives and uses of the invention, including what is believed to be the present best mode of carrying out the invention.

Figure 1:
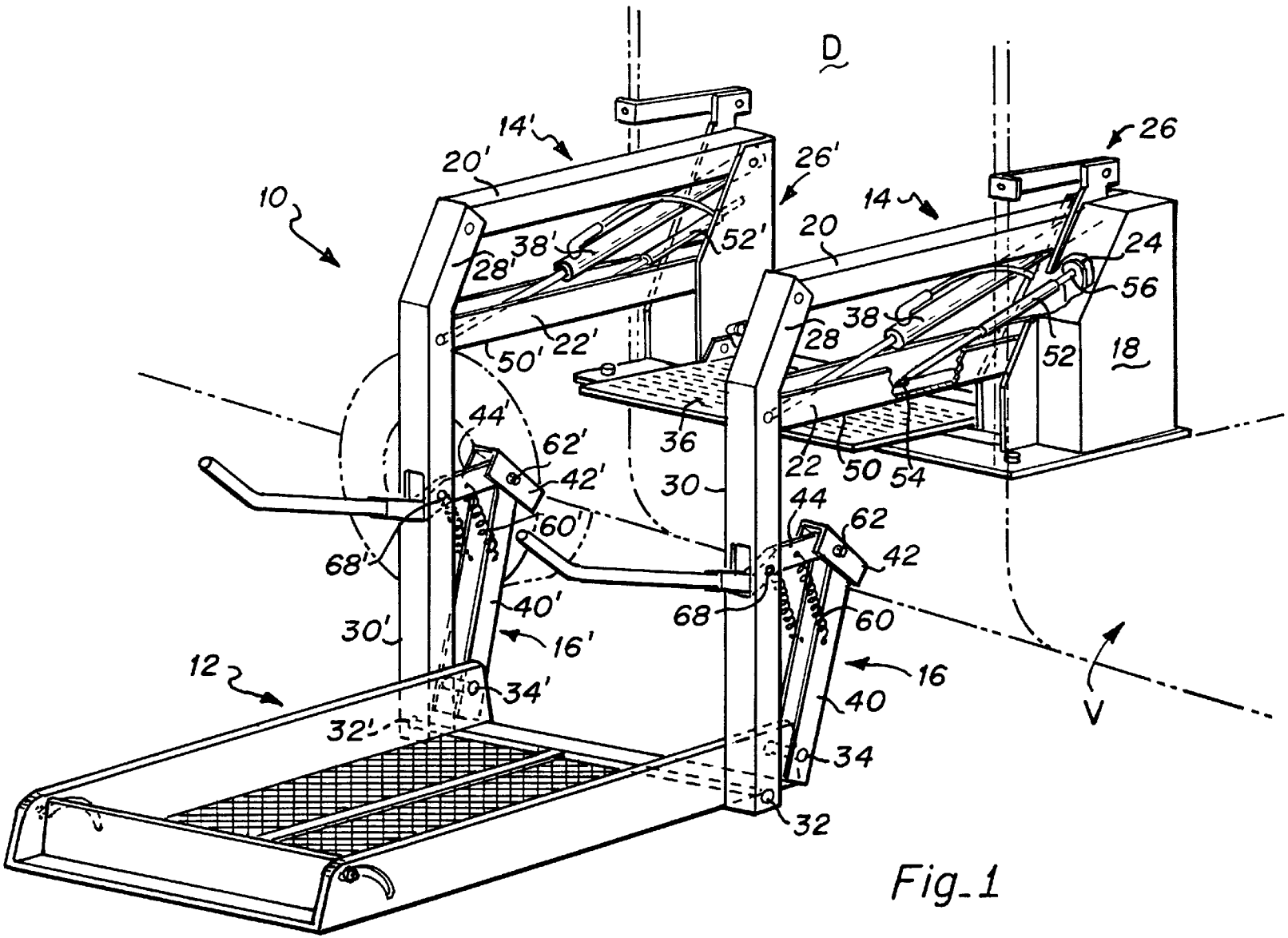
FIG. 1 is an isometric view of a typical Braun-type parallelogram lift where the hydraulic cylinder is the pull (retracting) type and is diagonally down in the platform ground position, and illustrates the gas spring assist.

FIG. 1 shows a Braun-type parallelogram lift 10 comprising platform assembly 12, paired parallelogram arm lifting assemblies 14, 14', articulated lever assemblies 16, 16' and hydraulic pump/control assembly 18 as mounted in vehicle V, for example in a side door opening, D. The lift assembly parallelogram comprises top links 20, 20' bottom links 22, 22' rear links 24, 24' (located but not visible in the stanchions 26, 26'), and the front links 28, 28'. The front link lower extensions 30, 30' are the lifting arms to which the platform assembly 12 is pivoted at 32 adjacent the inboard end, but outboard thereof a distance sufficient to provide a lever arm by the spacing between pivot 32 and the articulated lever arm lower pivot 34, 34'. The bridge plate is 36, and the lifting hydraulic cylinders are 38, 38'.

The articulated lever arm assembly 16, 16' comprises the lower, longer push arm 40, 40', the pivoting slide block (saddle block) 42, 42', and the short upper brace arm 44, 44'. The lift is shown at the ground level with the slide block 42 disengaged from sliding contact with the underside 50, 50' of the lower parallelogram arm 22, 22' (bottom link). The gas spring assist 52, 52' is secured at the outer, rod end 54 to the inside of the lower arm 22 and at the inner, cylinder end 56 to the rear link 24. Portions of the lower arm and stanchion cover are broken away to show the ends and securement points. One embodiment of the diagonal lever arm closure springs of this invention comprises tension spring pairs 60, 60' for each of the lever arm assemblies, but may be more or fewer springs. Preferably at least one spring is used, either internally or externally of the lever arm assembly channel members. In the Ricon stud/slot assembly, a reverse or compressive type torsion spring (having ends captured in tubes 76, 76', see FIG. 3) is used at each of the pivots 62, 62' to force the two arms of the articulated lever assembly together. The closure spring of the present invention may be used with or without such torsional pivot pin springs, preferably without, to eliminate torsional spring failure. Thus, in the invention the springs 60, 60' force the two arms together, hence being termed closure springs.

Figure 2:
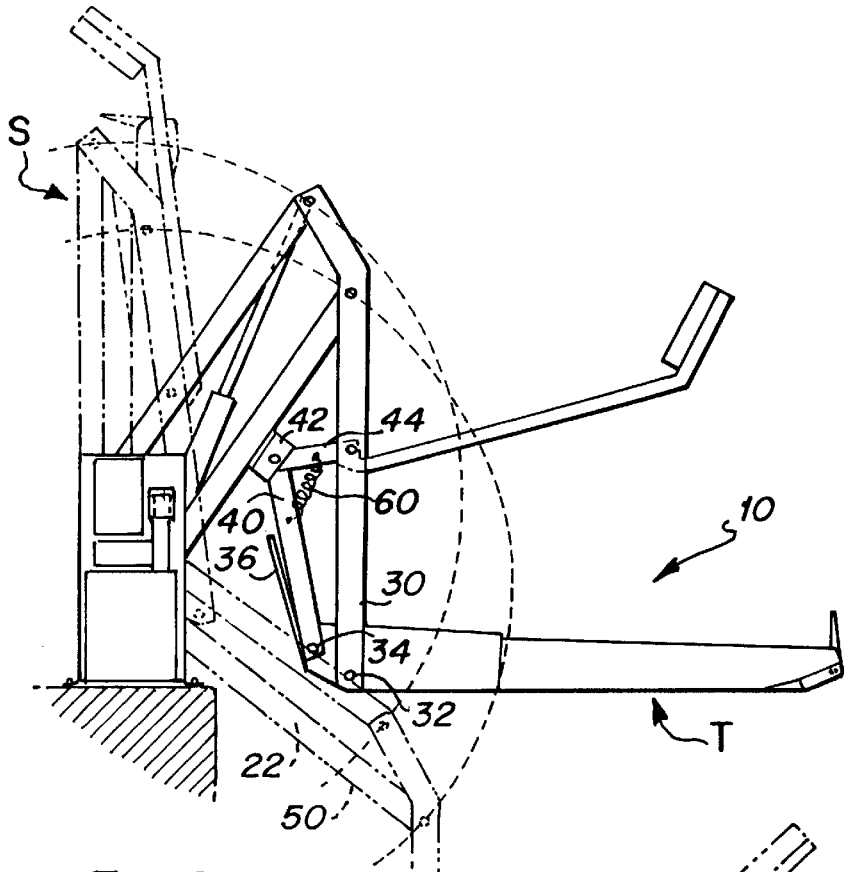
FIG. 2 is a side elevation view of a typical Ricon-type parallelogram lift showing the three basic positions, the lower ground position in dashed lines, the transfer or vehicle entry level position in solid lines, and the over-vertical stowed position, also in dashed lines.

FIG. 2 shows a Ricon-type lift at the ground position G, the transfer position T, and the stowed position S. A stud or button may be used on the face of the sliding block 42 (not shown, but see FIGS. 13–15 of U.S. Pat. No. 5,605,431 incorporated by reference herein to the extent necessary) to cooperate with a keyhole slot (not shown) on the underside 50 of the lower arm 22. The stud/slot assembly may be used in conjunction with the springs 60 and or gas spring 52 of this invention, but such stud/slot assembly is not required. The pairs of springs 60 are shown bridging arms 40 and 44, but may bridge between one arm 40 or 44 and the lift arm 30.

Figure 3:
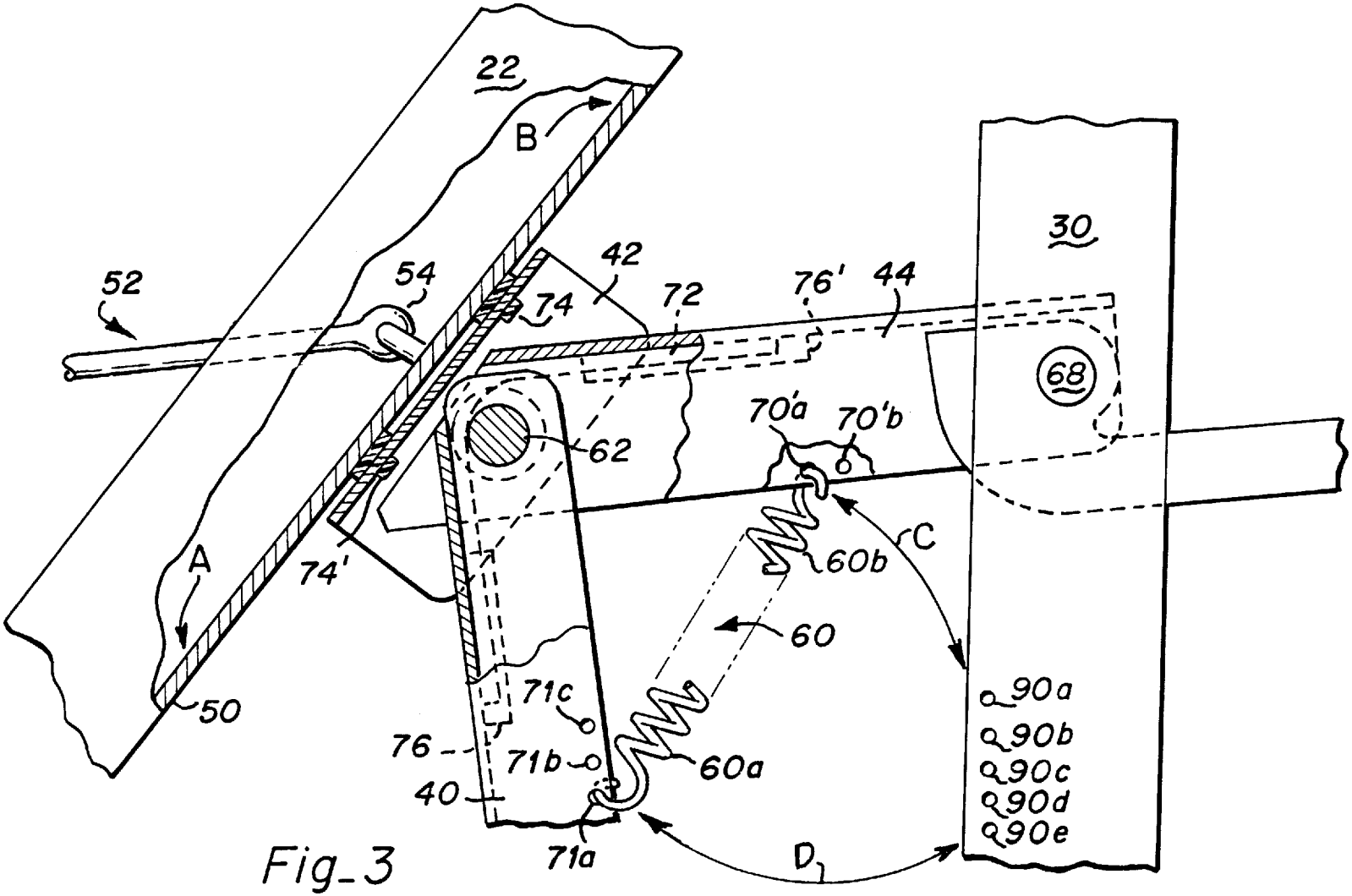
FIG. 3 shows in side elevation the diagonal spring of the invention spanning and connecting the two arms of the articulated lever assembly.

FIG. 3 illustrates an enlarged view of the closure spring assembly, in this case a pair of springs 60, comprised of outer spring 60*a* and inner spring 60*b* (one on each side of the U channels of the arms 40, 44, as shown). These springs are tension type springs, preferably reverse wound, which are mounted in holes 70 drilled in each pair of arms. Note the array of holes 70*a, b, c* . . . in each of the arms 40, 44. This permits tension adjustment. Also note holes 90*a*–90*e* in the lifting arm extension. These can serve as anchor points for the springs spanning from, say, 70*a*' to 90*b* as shown by arrow D, or 71*a, b, c* to 90*e* as shown by arrow C, by way of example.

In the Ricon stud/slot system a torsion spring 72 is used with ends captured in tubes 76, 76'. That torsion spring preferably is eliminated in the present invention as it is prone to failure, can apply only limited force, and during its life the force changes as it fatigues. The two arms 40,44 are pivoted at one end, commonly with the slide block 42, all journaled on pivot pin 62. The face of the slide block preferably employs hardened low friction plastic buttons 74, 74', to reduce wear, such as ultra high molecular weight polyethylene.

The gas spring 52 (spring-enclosed rod end only shown) is pivotally secured at 54 to the inside of the bottom of the U-shaped channel member forming the lower arm 22. The position shown is only approximate and schematic. Where a keyhole slot is used with a stud, the gas spring attachment point may be at another location above or below the slot, e.g., at or near point A or point B (preferable), depending on the amount of outward leverage force required to provide gas spring assist to overcome the resting momentum of the over-vertical platform. This is a function of the mass of the platform, the frictional resistance of the pivots or bearings, and the hydraulic fluid bleed rate upon opening the hydraulic valve for the unstowing, gravity down motion. The tension imparted by springs 60 provides a smooth, more controlled unfold without interfering with the deploy (descent) rate down to approximately the transition level. FIG. 3 shows the contact of slide lock 42 at approximately that level. It should be noted that the width between the side walls of the channel member forming the lift arm 30 is enough to provide clearance for the springs 60. That is, when the platform is fully stowed (position s in FIG. 2) the springs and arms 40, 44 completely recess within arm 30 without interference.

Figure 4:
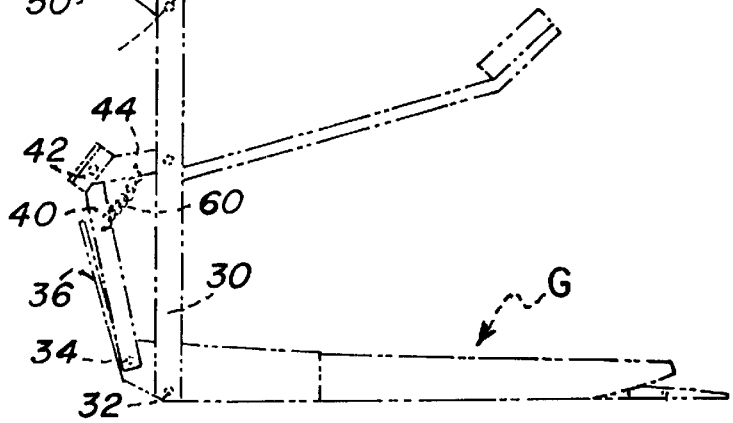
FIG. 4 shows in isometric a typical parallelogram pivot spring of the prior art which the present invention replaces.
Figure 4:
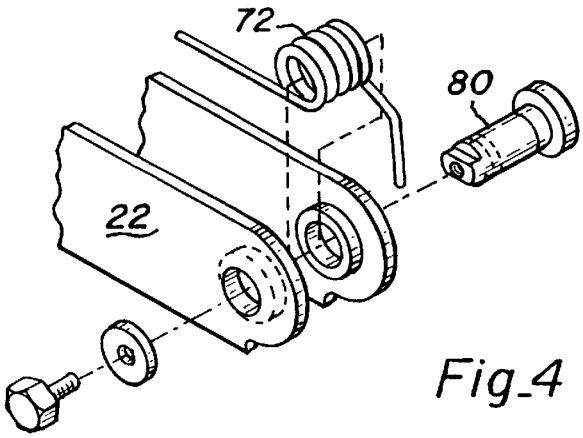

FIG. 4 shows a conventional pivot pin torsion spring 72 mounted at the inboard end of lower arm 22 around the pivot pin 80. The rear link is not shown, but the pivot pin assembly also passes through the walls thereof. This type of torsion spring is eliminated in this invention by the balancing of the spring forces of the gas spring 52 (outward) and the diagonal closure spring(s) 60 (inward). This is the type of spring used in the stud/slot arrangement of Ricon (see FIG. 3). It is evident that since such springs are over stressed, they fatigue and/or fail. Being "buried" in the lift assembly, they are costly to replace. In contrast the external closure springs 60 are easy to retrofit and replace.

INDUSTRIAL APPLICATION

It is evident that the closure spring system of this invention (alone or in combination with the gas spring (preferable), or a stud/slot assembly (optional), or the slide block reverse torsional spring), provides a simple, inexpensive, easy to replace, repair and retrofit solution to platform free fall, without introducing the problems of pivot pin torsion spring failure/fatigue or stud/slot binding and wear problems, while providing better deploy control.

It should be understood that various modifications within the scope of this invention can be made by one of ordinary skill in the art without departing from the spirit thereof. For example, the gas spring and the closure spring system can be applied to a side whale and bearing assembly, to lifts of types other than dual parallelogram lifts, and the like. The gas spring can be external to the lifting parallelogram, as for example in the case of the Ricon-type lift where the lifting ram orientation is reversed, thus not providing internal clearance for the gas spring. The diagonal closure springs can be substituted with hydraulic cylinders, reverse gas springs (tension rather than compression type), chain or cable drive linkages, or the like. Likewise the gas spring can be hydraulic, pneumatic or a linear actuator if it is desired to be an active element rather than a stored energy element. While the platform stowage assembly is herein termed a lever arm system, it may also be called a second, smaller parallelogram system to distinguish it from the lifting parallelogram assemblies. As an alternate embodiment the closure springs can span between either arm 40, 44 of the articulated lever assembly and the lower extension arm 30, or three pairs of springs, arrayed generally in a triangle between arm 44, vertical arm 30 and arm 40 may be used. Also, the stud, button or bearing of the stud/slot assembly may be replaced with an electromagnet assembly. We therefore wish this invention to be defined by the scope of the appended claims in view of the specification as broadly as the prior art will permit.

We claim:

1. A system for controlling wheelchair lift platform free fall motion from stowage position toward transfer position in a lift having a lever arm system, comprising in operative combination;

a) a lifting parallelogram having a top arm, a bottom arm, an inboard link and an outboard link, said outboard link including a generally vertical lifting arm having a lower end to which is pivotally secured a platform;

b) a lever arm assembly having a first, upper short arm pivotally secured at a first end to said lifting arm and at an opposite end to an upper end of a second, longer arm, and a slide block pivotally mounted coaxially with the pivot connection of said first and second arm, said second arm having a lower end pivotally mounted to said lift platform inboard of the pivot connection of said lift arm to said platform;

c) tension means for biasing said first and second arms of said lever arm assembly to urge said slide block against the lower surface of said lifting parallelogram bottom arm so that upon gravity down motion of said lift platform from vertical or over-vertical to substantially horizontal positions, said lift platform is controlled to reduce or eliminate outward drift generally parallel to the stowed position and thence into free fall, but rather pivots in an arcuate motion with said lever arm slide block in contact with said bottom lifting parallelogram arm.

2. A free fall control system as in claim 1 which includes:

a) compressive force means for assisting outward deploy motion of said lifting parallelogram from a vertical or over-vertical position during a gravity down mode; and b) said compressive force means is mounted between a rear link and an arm link of said lifting parallelogram and urges said platform outwardly from an over-vertical stowed position to assist in overcoming resting momentum of said platform mass.

3. A free fall control system as in claim 1 wherein said slide block pivot does not include a torsion spring.

4. A free fall control system as in claim 1 wherein said lifting parallelogram pivots do not include torsion springs.

5. A free fall control system as in claim 2 wherein said slide block pivot does not include a torsion spring.

6. A free fall control system as in claim 2 wherein said lifting parallelogram pivots do not include torsion springs.

7. A free fall control system as in claim 1 wherein said tension means is at least one spring.

8. A free fall control system as in claim 7 wherein said spring is mounted at one end to said upper short arm and at its other end to said longer lower arm.

9. A free fall control system as in claim 2 wherein said compression means is a gas spring.

10. A free fall control system as in claim 1 which includes a stud and slot assembly releasably locking said lower lifting parallelogram arm to said sliding block.

11. A free fall control system as in claim 10 wherein said stud is on said sliding block and said slot is on the underside of said arm.

12. A free fall control system as in claim 11 wherein said tension and compression means are selected to provide a predetermined amount of outward assist to said platform while keeping said slide block in contact with the lower arm of said lifting parallelogram.

13. A free fall control system as in claim 7 wherein said spring is mounted at one end to a short arm of said lever arm assembly, and its opposite end to said vertical lifting arm.

14. A free fall control system as in claim 7 wherein said spring is mounted at one end to a long arm of said lever arm assembly, and at its opposite end to said vertical lifting arm.

15. A free fall control system as in claim 8 wherein said spring is mounted at one end to a short arm of said lever arm assembly, and its opposite end to said vertical lifting arm.

16. A free fall control system as in claim 8 wherein said spring is mounted at one end to a long arm of said lever arm assembly, and at its opposite end to said vertical lifting arm.

17. A free fall control system as in claim 15 wherein said spring is mounted at one end to a long arm of said lever arm assembly, and at its opposite end to said vertical lifting arm.

* * * * *